US005360382A

United States Patent [19]

Chi

[11] Patent Number: 5,360,382

[45] Date of Patent: Nov. 1, 1994

[54] DIRECT-DRIVE TENSION DEVICE USING D.C. MOTOR

[76] Inventor: Wu Hong Chi, No. 1-2, Lane 975, Chun-Jih Road, Tao-Yuan City, Taiwan, Prov. of China

[21] Appl. No.: 181,222

[22] Filed: Jan. 13, 1994

Related U.S. Application Data

[63] Continuation-in-part of Ser. No. 74,382, Jun. 10, 1993, Pat. No. 5,304,104.

[51] Int. Cl.[5] ..... A63B 21/00

[52] U.S. Cl. ..... 482/1; 482/99; 482/115; 482/903

[58] Field of Search ..... 482/1–9, 482/99, 102, 115–119, 903; 601/23, 33

[56] References Cited

U.S. PATENT DOCUMENTS 4,979,733 12/1990 Prud'Hon ..... 482/116 X
5,133,545 7/1992 Moschettie et al. ..... 482/903 X
5,178,594 1/1993 Wu ..... 482/903 X
5,180,348 1/1993 Saarinen ..... 482/903 X

*Primary Examiner*—Richard J. Apley
*Assistant Examiner*—Glenn E. Richman
*Attorney, Agent, or Firm*—Morton J. Rosenberg; David I. Klein

[57] ABSTRACT

This novel invention employs state of the art technology together with a powerful D.C. motor to simulate the effect of the weight stack in an exercise machine. In order to reduce the friction loss and response time, a D.C. motor with a unique transmission mechanism is specially designed to accommodate the requirements of our system. A torque that simulates the weight stack is generated when a current is fed to the coils of the motor. To minimize the power disspation of the controller, an ingenious technique, termed VARIABLE CURRENT SOURCE METHOD, based on switching power supply is used to produce enough current without much power loss. As a result, the 'weight' that the user experiences can be varied according to the amount of current the controller produces.

1 Claim, 8 Drawing Sheets

DIRECT-DRIVE TENSION DEVICE USING D.C. MOTOR

RELATED APPLICATION

This patent application is a continuation-in-part of patent application Ser. No. 08/074,382, filed on Jun. 10, 1993, now U.S. Patent No. 5,304,104.

BACKGROUND OF THE INVENTION

1. Field of the Invention

This invention relates to a tension device and, more particularly, this invention employs state of the art technology together with a powerful D.C. motor to simulate the effect of the weight stack in an exercise machine.

2. Prior Art

Current muscle training machines can be divided into following two classes.

1. Spring load: As shown in FIG. 7, the winch 9A includes a spring as the means of generating a counterforce. When the cable 91 is pulled by the user interface, the disk 92 rotates and the spring 93 is wound. A counterforce proportional to the displacement of user interface is generated by the spring 93 accordingly. However, this counterforce cannot be controlled during the exercise.

2. Weight stack: As shown in FIG. 8, the system 9B includes a cable 91 and weight stack 94. As a force is applied on the cable 91, a counterforce due to gravity is produced by the weight blocks attached to the cable. This force can be varied by changing the number of the blocks manually. Nevertheless, to increase has to be interrupted increase or decrease the number of weight blocks.

SUMMARY OF THE INVENTION

The objective of this invention (referred as auto-tension device thereinafter) is to provide a constant or variable counterforce during the exercise. Furthermore, a user is able to select suitable exercise profiles through an electronic panel to meet different needs. Best of all, this system is compact and portable hence it can be installed on most of the existing exercise machines.

DETAILED DESCRIPTION OF THE PREFEERRED EMBODIMENT

Figure 1:
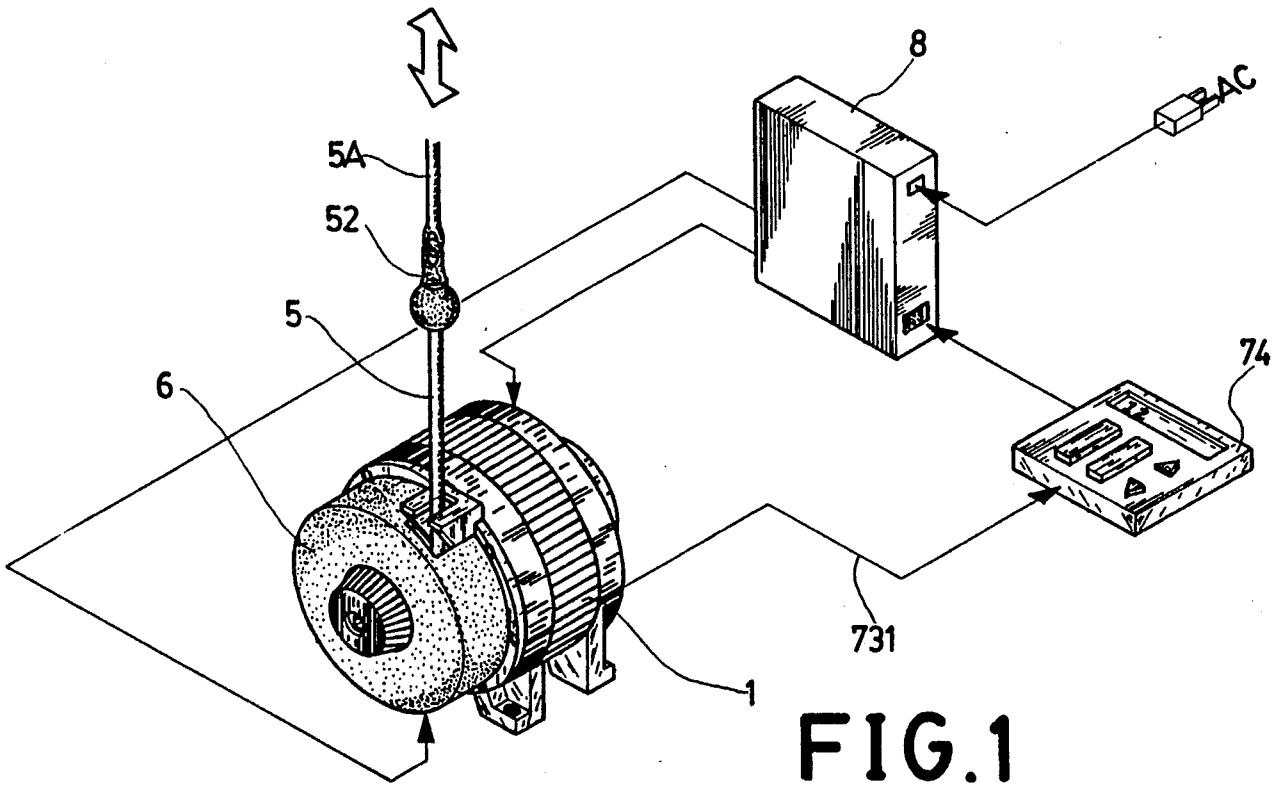
FIG. 1 is a perspective view of an assembled system.
Figure 2:
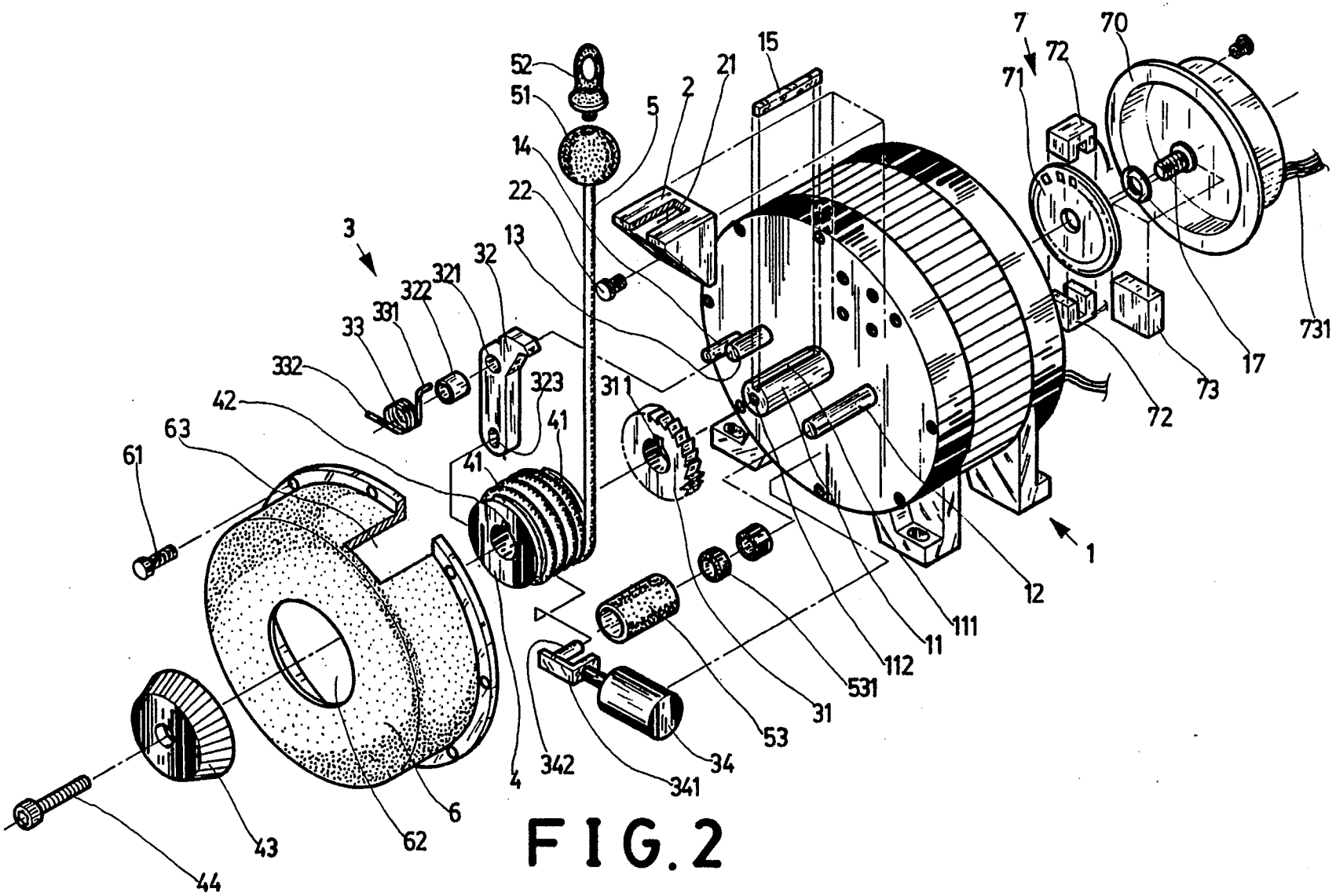
FIG. 2 is an exploded perspective view of the tension device.
Figure 2A:
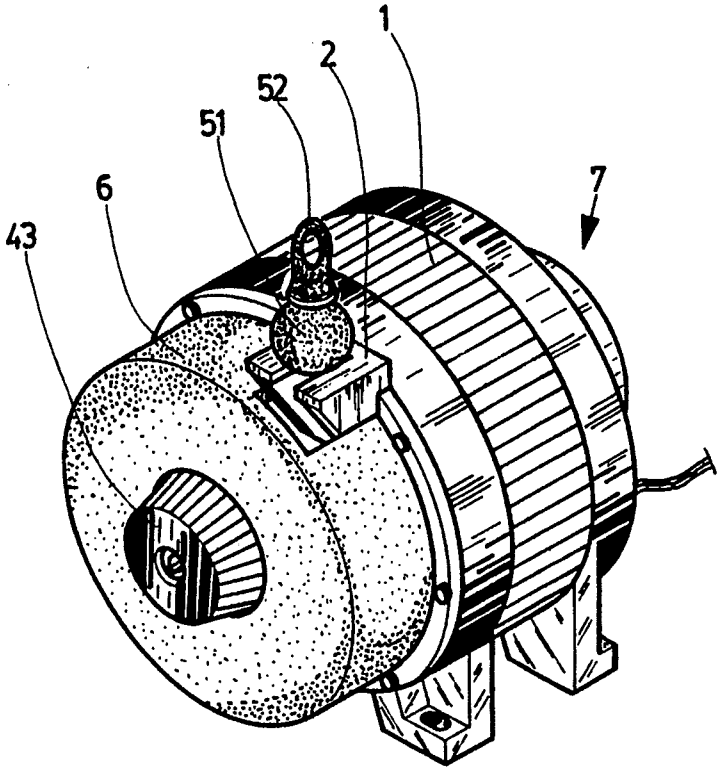
FIG. 2A is an assembled perspective view of the tension device.

Refer to FIGS. 1, 2, 2A, 3 and 4, the auto-tension device comprises a motor 1, DC motor or DC servo motor, a key slot 111 and a screw hole 112 are on the output shaft 11. A shaft 12 and stationary shaft 13 are placed on the front cover of the motor. A stationary post 14 is placed beside the stationary shaft 13.

A stopping bracket 2 has a slot 21 at the center portion, this stoppping bracket is attached to the front cover of the motor by means of screw member 22. This stopping bracket 2 is on the upper portion of the output shaft 11.

A locking device 3 is attached to the front portion of the motor 1. This locking device 3 comprises ratchet wheel 31 which has a key slot 311. The shaft hole is attached to the output shaft 11 by a key member 15.

A pawl 32 has a sleeve 322 within the shaft hole 321. The pawl is attached to the stationary shaft 13. A slot hole 323 is provided at the lower portion for pivoting.

A spring 33 is fixed to the upper portion of the pawl 32 at one end and is attached to a stationary post 14 at the other end.

A solenoid member 34 is used to extend or retract the brake bracket 341. A connecting post 342 is disposed at one side of the brake bracket 341 for pivoting the slot hole 232 of the pawl 32. This solenoid 34 is disposed at the lower portion of the output shaft 11.

A winch 4 has a spiral slot 41 thereof. This winch 4 has a shaft hole which has a key slot 42 thereof to be attached to the output shaft 11. A knob 43 is disposed at the outer side of the winch 4. This knob 43 is attached to the output shaft 11 by means of a screw member 44.

A cable 5 is attached to the spiral slot 41 at one end and the other end is connected to a rubber ball 51. This rubber ball 51 is retained in a slot 21 of the stopping bracket 2. A connecting ring 52 is disposed at the rubber ball 51.

A guiding wheel 53 is attached to the shaft 12 by means of two bearings 531. This guiding wheel 53 is placed against the cable 5.

A safety cover 6 is attached to the front portion of the motor 1. A hole 62 is provided at the upper portion for extending of the knob 43.A slot 63 is provided in the stopping bracket 2 for pulling out the cable 5 from the slot 21 of the stopping bracket 2.

Figure 6:
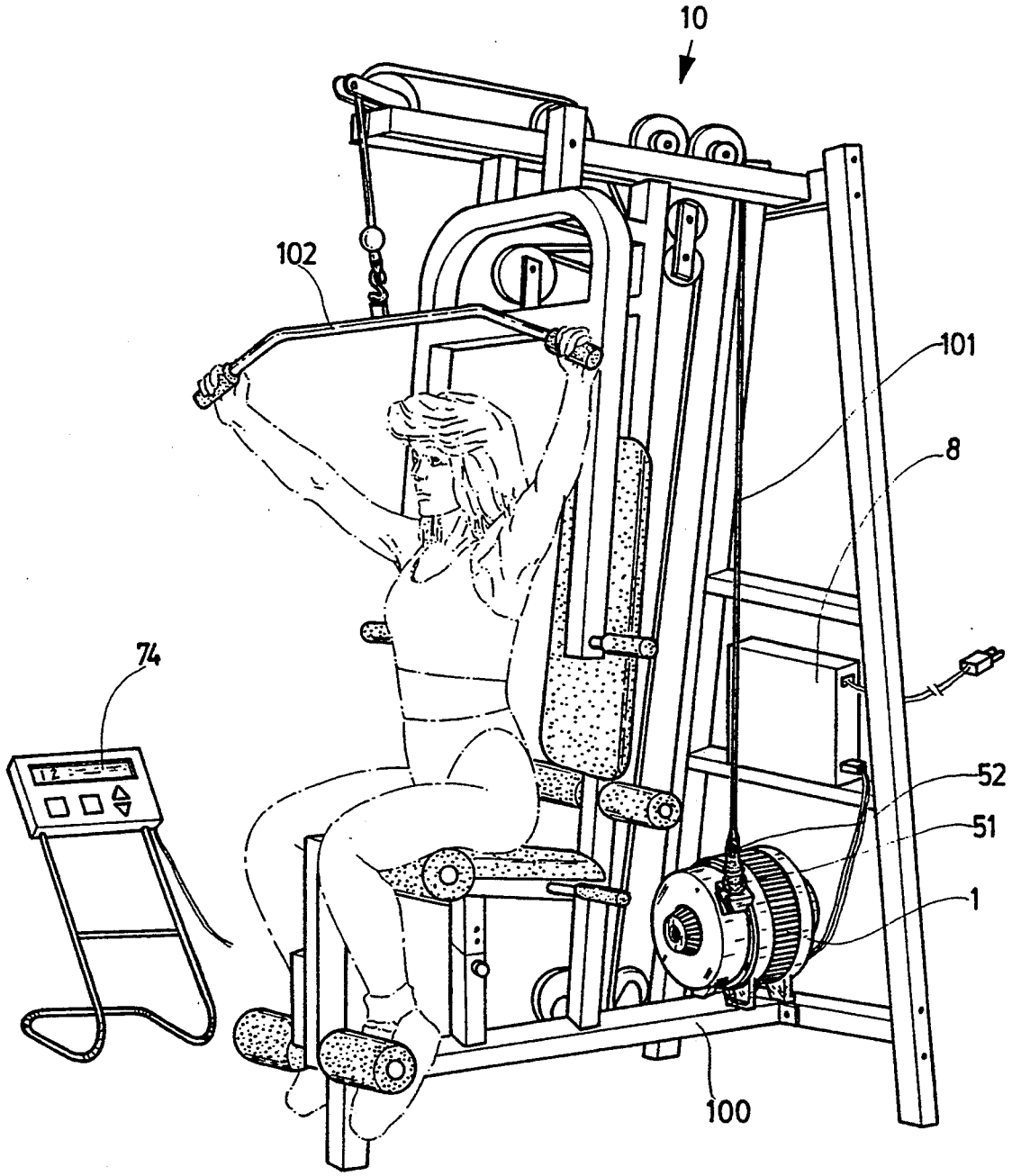
FIG. 6 is an application example of the system.
Figure 7:
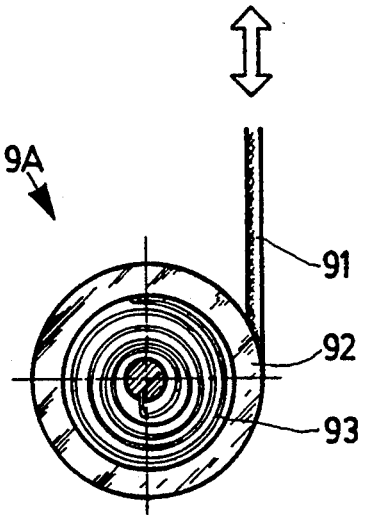
FIG. 7 (PRIOR ART)
FIG. 7 is a sketch of a conventional spring type system.
Figure 8:
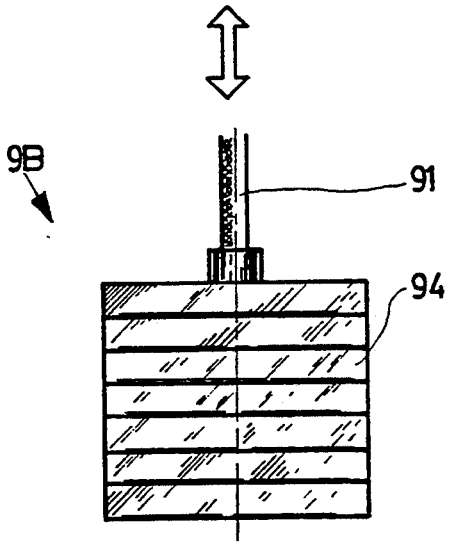
FIG. 8 (PRIOR ART)
FIG. 8 is a sketch of a conventional weight-stack type system.

A decoder 7 has a decoding wheel 71 attached to the output shaft 16 of the motor 1. Two photo couplers 72 are disposed at both sides of the decoding wheel 71. These photo couplers 72 are electrically connected to a decoding circuitry 73. A safety cover 70 is disposed at the rear portion of the motor 1. This decoding circuitry 73 is electrically connected to a computer controller 74 by means of bus 731, as shown in FIG. 6.

A controller 8 is used to send a corresponding current to the motor 1 by converting the signal from the computer controller 74. This controller 8 keeps the current in a preset level despite of the rotation of the motor 1. Consequently, a steady torque and tension are achieved.

Figure 3:
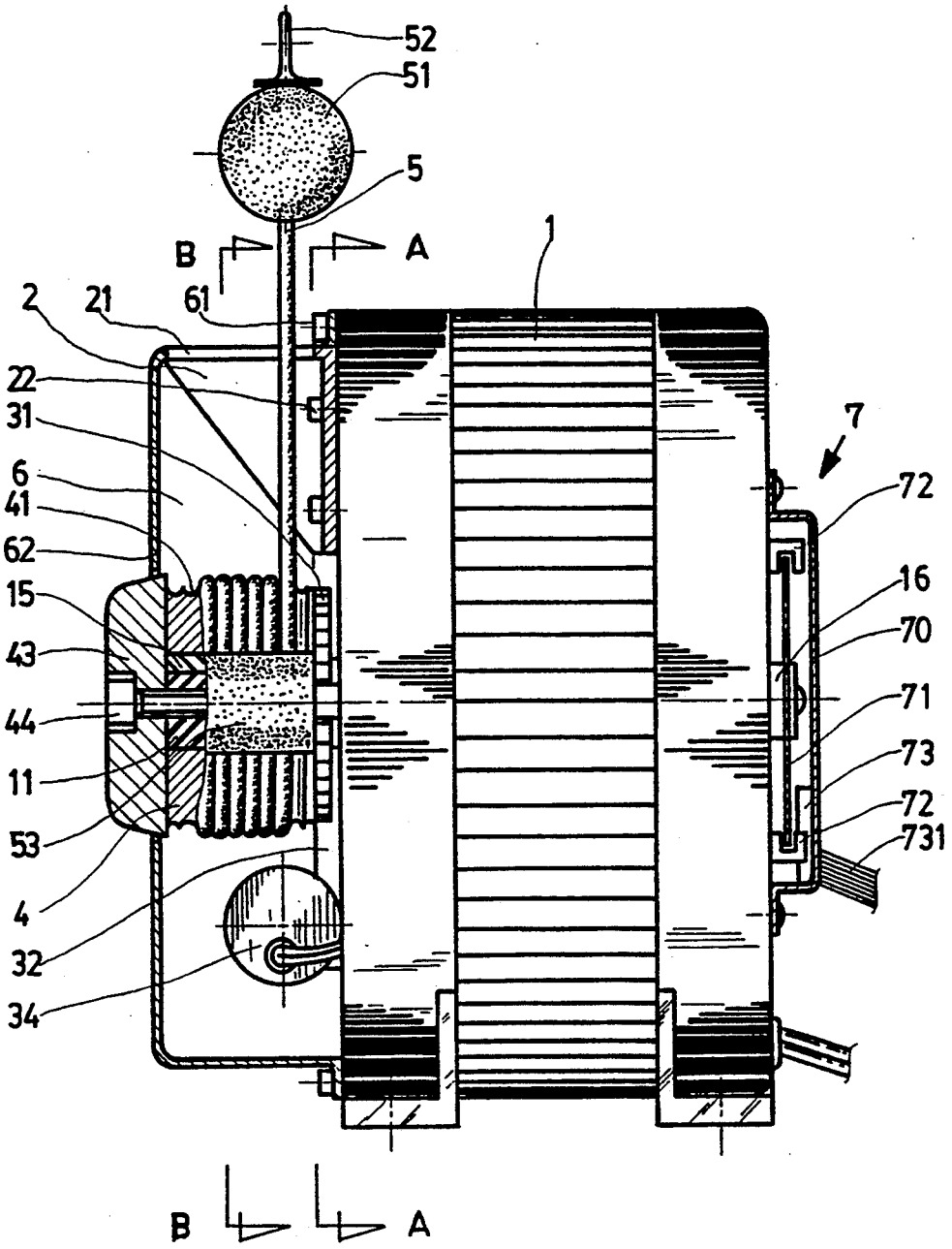
FIG. 3 is a cross sectional side view of the tension device.
Figure 4:
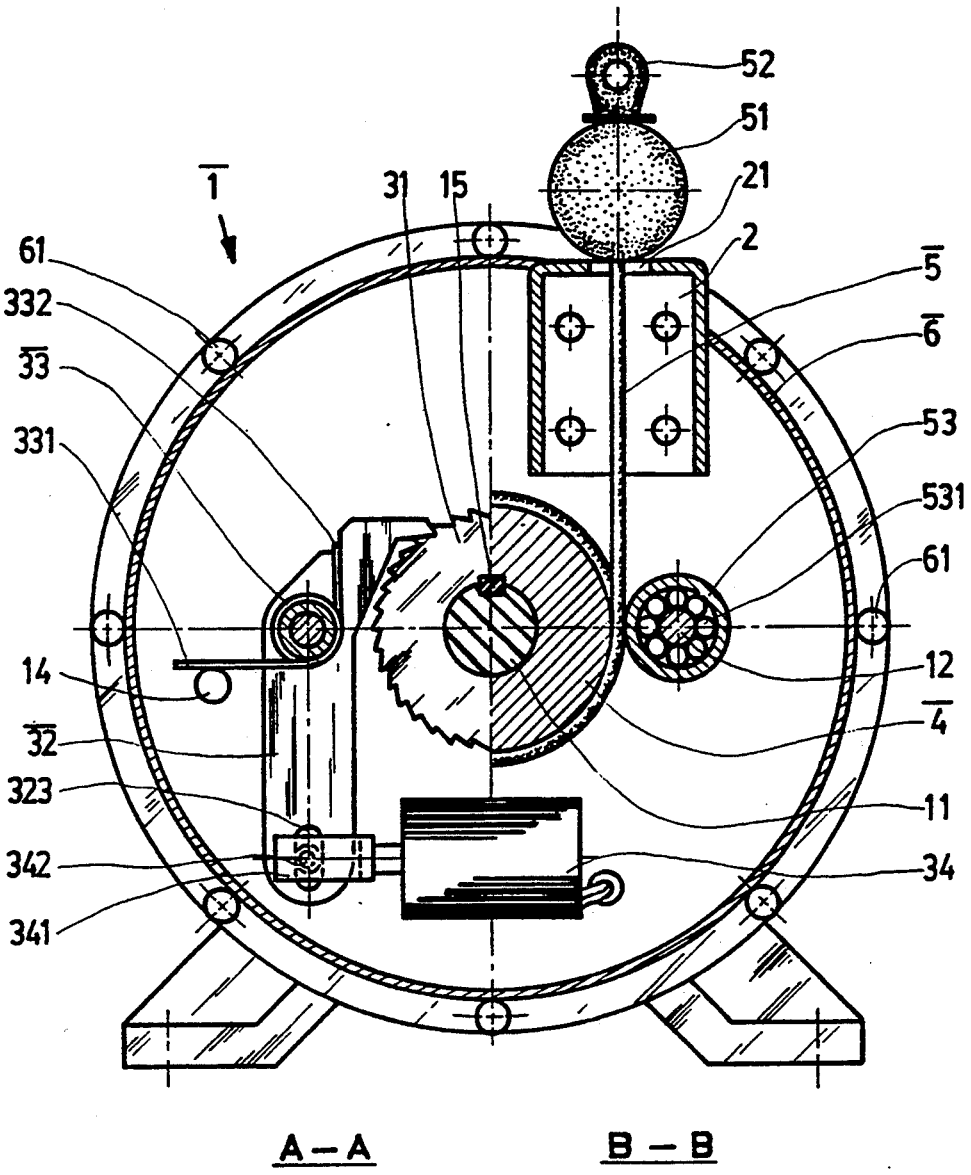
FIG. 4 is a cross sectional view of the tension device along the line A—A and B—B of FIG. 3.
Figure 5:
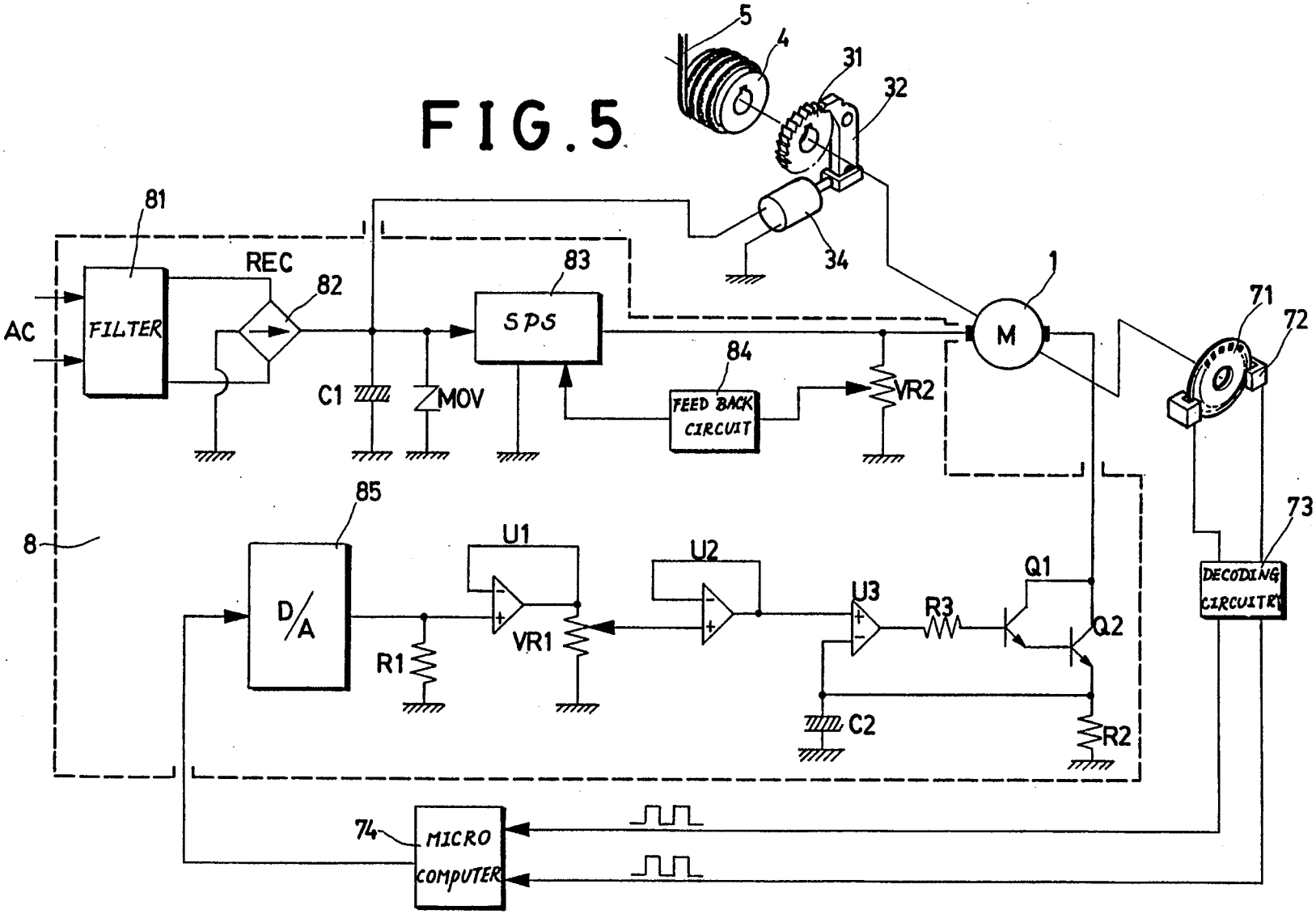
FIG. 5 is a functional circuitry of the controller.

The theory and operation of the auto-tension device can better described with the reference of FIGS. 3, 4 and 5. The auto-tension device utilizes the linear relationship between the torque and the current of a DC or DC servo motor. The controller 8 is controlled by a micro-computer 74, consequently a constant current will be supplied to the motor 1. Accordingly, a steady torque is obtained at the output shaft 11. On the other hand, a winch 4 is disposed at the output shaft 11 of the motor 1. Hence the rotating torque is converted into a linear tension in the cable 5. By this arrangement, a steady tension is maintained in the cable 5, regardless whether the cable 5 is pulled or released.

Moreover, for an easy fitting of the cable 5 to the winch 4, a spiral slot 41 is provided at the winch 4. In light of this, the cable 5 is rewound orderly on the winch 4 in both directions.

On the other hand, in order to prevent the cable 5 from being totally rewound into the winch 4, a safety cover 6 with a slot 21 which provides a passage to the cable 5. A rubber ball 51 which has a larger diameter than the width of the slot 21 is attached to the cable 5 to prevent the cable 5 from being totally rewound.

In order to prevent the cable 5 from being totally pulled out, when the power is switched off or interrupted, a locking device 3 is provided to avoid the cable 5 being pulled out. The pawl 32 is engaged to the ratchet wheel by a spring member 33, thus, the pawl 5 and ratchet wheel 31 prevent the output shaft 11 from rotating counterclock-wise. The cable 5 is retained thereof on the rewinding drum 4. When the power is switched on, the pawl 32 is retraced by the actuation of the solenoid 34. The ratchet wheel 31 is released by the pawl 32 and then can rotate freely thereof. The cable 5 is free to move. By the provision of this locking device 3, this cable 5 is retained thereof when the power is switched off or interrupted.

In addition, a knob 43 is provided at one side of the output shaft 11. When the power is interrupted during the retrac-tion of the cable 5, the cable 5 can be rewound back to the winch 4 by turning the knob 43.

Further more, the rotation of the output shaft 16 of the motor 1, as shown in FIG. 3, is the same as the rotation of the output shaft 11. When the output shafts 11, 16 rotate, the decoding wheel 71 behind the output shaft 16 rotates as well. The photo couplers 72 detect this signal from the decoding wheel 71, consequently,- the decoding circuit 73 converts this signal into a series of clockwise or counterclockwise pulses. The micro-computer 74 will calculate the distance which the cable 5 travels by counting these pulse-trains, the accordingly the calories exhausted during the exercise can be accurately calculated.

Refer to FIG. 5, a circuitry for current control device 8 is disclosed. The circuitry is used to control the current supplied to the motor 1 to change the torque therefrom. The current can be changed automatically by the micro-computer 74. The current control device 8 receives a high voltage through the filter 81 and bridge rectifier 82. Then this high voltage is sent to a power supply 83 after it passes through the capacitor C1 and surge protector MOV. The output of the power supply 83 is connected to the motor 1 in series with a transistor Q2 and resistor R2. The voltages at both ends of the motor 1 are picked up and sent to a feedback circuit 84 for controlling the switching power supply 83. A group of signal is sent to a digital/analog signal converter 85 from the microcomputer 74 for controlling the magnitude the current. This signal is then sent to a buffer U1 and variable resistor. This signal is further sent to U3 from the voltage coupler U2. The output of the U3 is connected to the resistor R3 and this resistor R3 is connected to the base of the transistor Q1. The collector of the transistor Q1 is connected to the collector of the transistor Q2. The emitter of transistor Q1 is connected to the base of transistor Q2. The emitter of transistor Q2 is coupled to resistor R2 and non-inverting input of U3. The other end of the resistor is counected to ground. By this arrangement, the current supplied to the motor 1 can be controlled by the transistor Q2.

By the provision of this invention, the auto-tension device can be applied to many kinds of exercise machines, such as a rowboat simulator, weight lifting simulator and muscle trainer. The connecting ring 52 of the cable 5 can be interconnected with the pulling cable 5A of exercise machine to replace the weight stack or spring load. When the user pulls the cable 5 of the winch 4 upward, the direction of winch 4 is in opposite direction of the motor 1, then the motor 1 applies a torque or load to the user. If cable 5 is released, the torque from the motor 1 rewinds the cable 5 automatically and immediately. This device provides the same functions and feel as the conventional exercise machine, but without noise. On the other hand, the tension or loads can be adjusted easily and readily.

Refer to FIG. 6, the muscle trainer 10 is incorporated with this invention. The motor 1 is attached at the rear portion of the frame 100 to replace the conventional weight stack. The connecting ring 52 of the cable 5 is connected to the pulling cable 101 of the muscle trainer 10. When the user pulls the rope 5 upward, the rotation of the winch 4 is in opposite direction of the motor 1, then the motor 1 applies a torque or load to the user. A steady current is supplied to the motor 1 by the current control device 8. Therefore, a constant torque is achieved regardless pulling the actuating rods 102 or keeping still thereof.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claims.

What is claimed is:

1. An auto-tension device, includes following components:

a motor having a key slot and a retaining screw hole being provided at an output shaft, a shaft and stationery shaft being disposed at both sides of said output shaft, a stationary post being disposed at said outer side of said stationary shaft;

a stopping bracket having a slot at a center portion, said stopping bracket being attached to the front cover of the motor by means of a screw member, said stopping bracket being located on said upper portion of said output shaft;

a locking device attached to a front portion of said motor, said locking device comprising a ratchet wheel which has a key slot shaft hole being attached to said output shaft by a key member;

a pawl having a sleeve within said shaft hole, said pawl being attached to said stationary shaft, a slot hole being provided at a lower portion of said pawl portion for pivoting;

a spring being placed to an upper portion of said pawl at one end and being attached to a stationary post at other end;

a solenoid member being used to extend or retract said brake bracket, a connecting post being disposed at one side of said brake bracket for pivoting said slot hole of said pawl, said solenoid being disposed at a lower portion of said output shaft a winch having a spiral slot thereof, said winch having a shaft hole which has a key slot thereof to be attached to said output shaft, a knob being disposed at said outer side of said winch, said knob being attached to said threaded hole of said output shaft by means of a screw member;

a cable being attached to one end of said spiral slot at one end and said other end is connected to a rubber ball, said rubber ball being retained at a slot of said stopping bracket, a connecting ring being disposed at said rubber ball;

a guiding wheel being attached to said shaft by means of a bearing, said guiding wheel being placed against said cable;

a safety cover being attached to said front portion of said motor, a hole being provided at an upper portion of said safety cover for extending of said knob, a slot being provided to said stopping bracket for pulling out of said cable from said slot of said stopping bracket;

a decoder having a decoding wheel attached to said output shaft of said motor, a photo coupler being disposed at both sides for said decoding wheel, said photo coupler being electrically connected to a decoding circuitry, a safety cover being disposed at said rear portion of said motor, said decoding circuitry being electrically connected to a micro-computer controller by means of bus;

a current controller for sending a controlled current to said motor by converting said signal from the micro-computer, wherein the current is kept at a constant level regardless of rotation by said motor, thereby providing a steady torque and tension.

* * * * *